US009765728B2

(12) United States Patent
Bischofberger et al.

(10) Patent No.: US 9,765,728 B2
(45) Date of Patent: Sep. 19, 2017

(54) PISTON FOR AN INTERNAL COMBUSTION ENGINE

(71) Applicant: MAHLE International GmbH, Stuttgart (DE)

(72) Inventors: Ulrich Bischofberger, Esslingen (DE); Sascha-Oliver Boczek, Dielheim (DE)

(73) Assignee: MAHLE International GmbH, Stuttgart (DE)

( * ) Notice: Subject to any disclaimer, the term of this patent is extended or adjusted under 35 U.S.C. 154(b) by 76 days.

(21) Appl. No.: 14/424,706

(22) PCT Filed: Aug. 27, 2013

(86) PCT No.: PCT/DE2013/000491

§ 371 (c)(1),
(2) Date: Feb. 27, 2015

(87) PCT Pub. No.: WO2014/032644

PCT Pub. Date: Mar. 6, 2014

(65) Prior Publication Data

US 2015/0247475 A1 Sep. 3, 2015

(30) Foreign Application Priority Data

Aug. 31, 2012 (DE) ..... 10 2012 017 217

(51) Int. Cl.
*F02F 3/22* (2006.01)
*F01P 3/10* (2006.01)
(Continued)

(52) U.S. Cl.
CPC *F02F 3/22* (2013.01); *F01P 3/10* (2013.01); *F02F 3/0015* (2013.01);
(Continued)

(58) Field of Classification Search
CPC .... F02F 3/00; F02F 3/0015; F02F 3/18; F02F 3/16; F02F 3/20; F02F 3/28; B23P 15/10; B23P 19/042; F01P 3/06
(Continued)

(56) References Cited

U.S. PATENT DOCUMENTS 4,142,484 A 3/1979 Buhl
4,377,967 A * 3/1983 Pelizzoni ..... F01M 1/08 123/41.35
(Continued)

FOREIGN PATENT DOCUMENTS

DE 2 017 925 A 10/1971
DE 25 39 470 A1 3/1977
(Continued)

OTHER PUBLICATIONS

German Search Report dated Apr. 12, 2013 in German Application No. 10 2012 017 217.6 with English translation of relevant parts.
(Continued)

*Primary Examiner* — Hai Huynh
*Assistant Examiner* — Long T Tran
(74) *Attorney, Agent, or Firm* — Collard & Roe, P.C.

(57) ABSTRACT

A piston for an internal combustion engine includes a piston head and a piston skirt, wherein the piston head has a piston base, a circumferential ring part and, in the region of the ring part, a circumferential closed cooling channel or sealed cavity. An inner side of the piston has two lower surfaces which transform continuously in the region of the piston central axis (M) to form an arched surface. The piston skirt has piston hubs provided with hub bores which are interconnected by means of running surfaces which have inner surfaces facing the inside of the piston. Starting from the free ends of the piston skirt, inside the piston on the pressure side (DS) and/or counter pressure side (GDS), an inner
(Continued)

Figure 1:
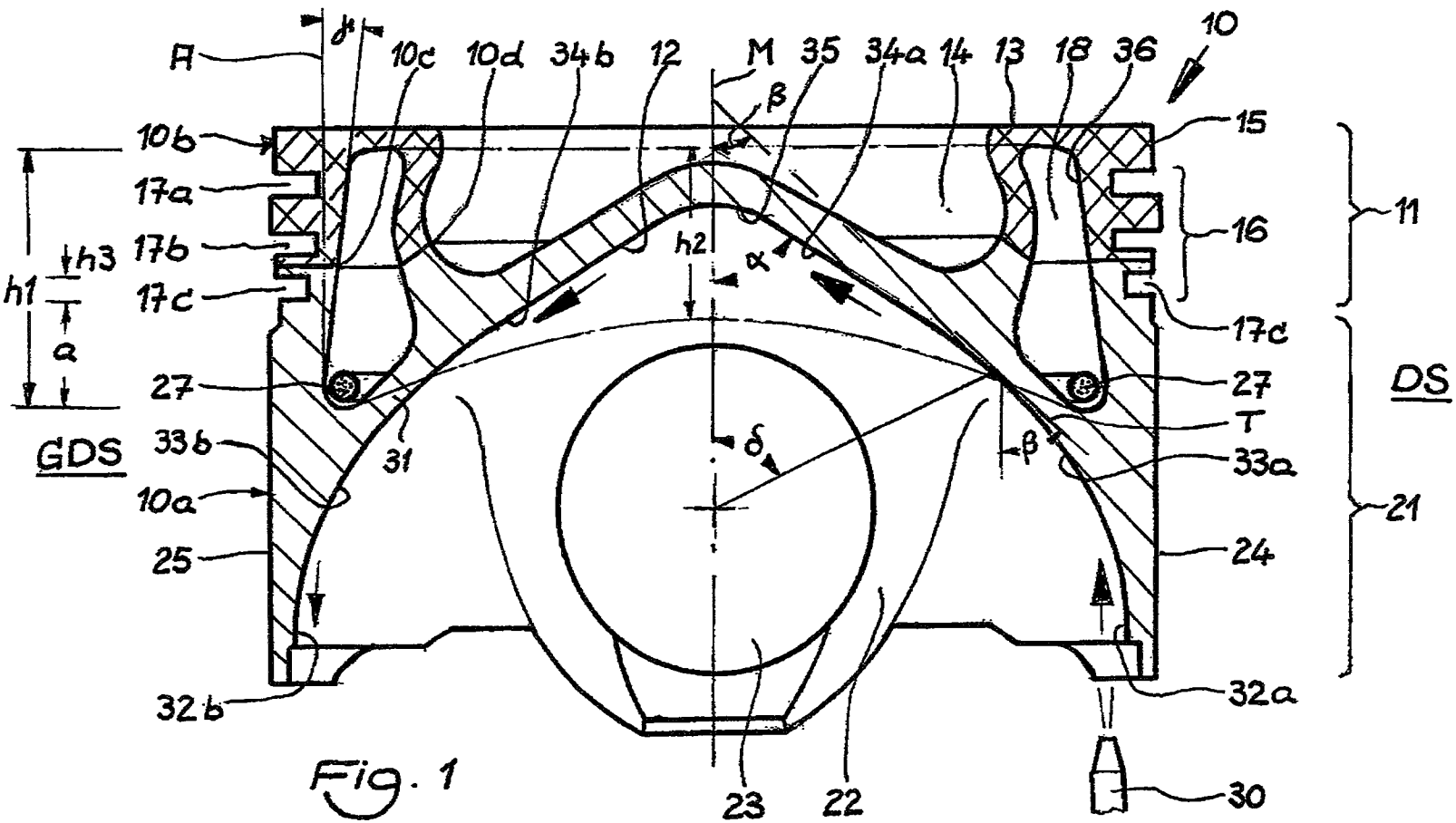

surface of a running surface continuously transforms into a guiding surface for a coolant which transforms continuously on the side thereof into a lower surface.

13 Claims, 3 Drawing Sheets

(51) Int. Cl.
*F02F 3/18* (2006.01)
*F02F 3/00* (2006.01)
*F01P 3/00* (2006.01)

(52) U.S. Cl.
CPC ..... *F02F 3/0084* (2013.01); *F02F 3/18* (2013.01); *F01P 2003/006* (2013.01)

(58) Field of Classification Search
USPC ..... 123/41.35, 41.34, 41.16, 193.1, 193.6
See application file for complete search history.

(56) References Cited

U.S. PATENT DOCUMENTS 4,593,660 A 6/1986 Elsbett et al.
6,477,941 B1 11/2002 Zhu et al.
6,487,773 B1 12/2002 Scharp et al.
6,494,170 B2 * 12/2002 Moloney ..... F01M 1/08 123/41.35
7,603,977 B2 * 10/2009 Heidrich ..... F02F 3/18 123/193.6
8,899,208 B2 12/2014 Bischofberger
2005/0087153 A1 4/2005 Moon
2010/0319648 A1 * 12/2010 Bauer ..... F02F 3/0023 123/193.6
2013/0047948 A1 * 2/2013 Heuschmann ..... F02F 3/22 123/193.6
2013/0104838 A1 * 5/2013 Spangenberg ..... F02F 3/16 123/193.6
2013/0146017 A1 * 6/2013 Muscas ..... B23P 15/10 123/193.6

FOREIGN PATENT DOCUMENTS

DE 26 13 059 A1 6/1977
DE 32 05 173 A1 8/1983
DE 32 10 771 A1 9/1983
DE 35 02 644 A1 7/1986
DE 42 43 571 A1 6/1994
DE 101 13 639 A1 9/2002
DE 602 04 296 T2 4/2006
DE 600 28 800 T2 5/2007
DE 10 2006 056 011 A1 5/2008
DE 10 2011 114 105 A1 6/2012
FR 2 333 962 A1 7/1977
JP 2001-304040 A 10/2001
WO 2012/079566 A2 6/2012

OTHER PUBLICATIONS

International Search Report of PCT/DE2013/000491, mailed Mar. 4, 2014.

* cited by examiner

PISTON FOR AN INTERNAL COMBUSTION ENGINE

CROSS REFERENCE TO RELATED APPLICATIONS

This application is the National Stage of PCT/DE2013/000491 filed on Aug. 27, 2013, which claims priority under 35 U.S.C. §119 of German Application No. 10 2012 017 217.6 filed on Aug. 31, 2012, the disclosures of which are incorporated by reference. The international application under PCT article 21(2) was not published in English.

The present invention relates to a piston for an internal combustion engine, having a piston head and a piston skirt, wherein the piston head has a piston crown, a circumferential ring belt, as well as a circumferential, closed cooling channel or a circumferential, closed cavity in the region of the ring belt, wherein an inside of the piston has two lower surfaces that make a constant transition into an arched surface in the region of the center piston axis, wherein the piston skirt has pin bosses provided with pin bores, which pin bosses are connected with one another by way of working surfaces, which have inner surfaces that face the piston interior.

The piston of the stated type is a piston having spray cooling, i.e. cooling of the piston takes place by means of spraying it with coolant from the piston-skirt-side end. It has been shown that in pistons having a small compression height, in particular, the coolant jet is predominantly thrown back directly from the impact location. This has the result that a noticeable cooling effect is brought about at this location, but at other locations, sufficient cooling is not achieved. For this reason, it is observed, in the case of such pistons, that they become too hot during engine operation at greater loads, and do not withstand long-term stress.

The task of the present invention consists in further developing a piston of the stated type in such a manner that more uniform spray cooling is achieved.

The solution consists in that an inner surface of the working surface makes a constant transition, proceeding from the free end of the piston skirt in the piston interior, on the major thrust side and/or minor thrust side, into a guide surface for cooling oil, which in turn makes a constant transition into a lower surface.

The piston according to the invention is characterized in that the sprayed-on coolant is not directly thrown back from the impact location. Instead, the coolant jet impacts the guide surface essentially tangentially, and is guided in such a manner that it flows over the lower surface in the direction of the arched surface. The coolant therefore flows back in the direction of the crankshaft with a significant delay. In the end result, for one thing, a significantly greater surface area on the inside of the piston is wetted with coolant and cooled, and for another thing, the coolant has a significantly longer dwell time on the inside of the piston. This leads, in total, to a clearly stronger and more uniform cooling effect on the inside of the piston. The heat transported to the inside of the piston from the direction of the piston crown during engine operation is conducted away significantly more effectively.

Advantageous further developments are evident from the dependent claims.

In an optimal case, the coolant is conducted by the guide surface in such a manner that it flows over the lower surface in the direction of the arched surface and beyond that over the opposite lower surface and guide surface in the direction of the crankshaft. For this reason it is preferred that the embodiment according to the invention is provided with a guide surface both on the major thrust side and on the minor thrust side.

A preferred further development provides that a tangent applied in the region of the inside, at an angle $\delta$ to the center piston axis, encloses an angle $\beta$ with the center piston axis, that each lower surface encloses an angle $\alpha$ with the center piston axis, and that the angle $\beta$ is less than or equal to the angle $\alpha$. The resulting geometry of the guide surface and of the lower surface allows particularly effective guiding of the sprayed-on coolant from the guide surface to the lower surface and a particularly advantageous coolant flow, in terms of flow technology. Particularly preferably, the tangent is applied in the region of a guide surface.

A particularly preferred embodiment of the present invention consists in that at least one bore closed toward the outside is provided, which bore is disposed between a working surface and a pin bore and opens into a coolant space, wherein the cavity and the at least one bore contain a heat transfer medium in the form of a metal having a low melting point or a metal alloy having a low melting point. Metallic heat transfer media bring about particularly effective cooling of the piston head and particularly effective heat distribution.

In such pistons, the "cooling channel" that usually accommodates cooling oil is completely closed, i.e. neither inlet openings nor outlet openings for coolant are present. For this reason, the discussion hereinafter in connection with such pistons will refer not to a cooling channel but rather to a closed cavity or, in short, a cavity.

In a piston filled with such a metallic heat transfer medium, the heat transfer medium cannot exit from the cavity. The heat absorbed by the heat transfer medium during engine operation, from the direction of the piston crown, is given off directly to the surroundings, particularly to the region of the ring belt and to the lower region of the cavity. For this reason, the configuration, according to the invention, of the inside of the piston is particularly preferred in connection with such pistons. The heat absorbed by the heat transfer medium is transferred in the direction of the inside of the piston and transported away particularly effectively by the sprayed-on coolant.

In such pistons, the maximal height of the cavity in the region of the working surfaces is preferably greater than its maximal height in the region of the pin bosses. As a result, the heat transferred by the heat transfer medium to the inside of the piston in the region of the working surface can be transported away particularly effectively by the sprayed-on coolant. In the region of the working surfaces, the wall thickness of the inside of the piston is so slight that effective heat transfer takes place, without impairing the stability of the piston. The symmetrically varying cross-section of the cooling channel furthermore leads to the result that the piston according to the invention is better balanced and therefore can be better guided in the cylinder during engine operation. Lower friction losses are found than those in the state of the art.

A further advantageous embodiment of the piston according to the invention provides that a lowermost ring groove having a groove height h3 is provided within the ring belt, that a distance a is provided between the lower flank of the lowermost ring groove and the lowest point of the cavity, and that the distance a is equal to or greater than the groove height h3. The greater the difference between the groove height and the distance, the greater the maximal height of the cavity, and therefore the more effective the heat transfer from the heat transfer medium accommodated in the cavity to the inside of the piston. Furthermore, the greater the distance between the lower flank of the ring groove and the lowest point of the cavity, the less heat is transferred to the region of the lowermost ring groove during engine operation, so that the risk of carbonization is greatly reduced or completely prevented in this region.

Preferably, an outer wall of the cavity facing the ring belt, in the direction of the piston crown, is configured to be inclined, at least in part, toward the center piston axis. As a result, the movement of the heat transfer medium accommodated in the cavity, brought about by what is called the "Shaker effect" is optimized during the piston stroke during engine operation. Furthermore, too much heated heat transfer medium is prevented from coming into contact with the outer wall and excessively heating the ring belt, so that the risk of carbonization in the region of the ring grooves is prevented.

It is practical if the inclined outer wall of the cavity encloses an angle of 1° to 10° with an axis parallel to the center piston axis. In this way, the cavity is additionally prevented from being excessively constricted, and an effective heat transfer effect is maintained.

Preferably, the fill amount of the heat transfer medium amounts to 5% to 10% of the total volume of the cavity and of the at least one bore. This has the advantageous effect that the metallic heat transfer medium transports the heat more effectively into the lower region of the cavity, in the direction of the piston skirt, so that less heat is given off in the direction of the ring belt.

In this piston type, it is particularly advantageous to configure an outer wall of the cavity facing the ring belt, in the direction of the piston crown, to be inclined, at least in part, toward the center piston axis, in order to prevent excessive heating, as it is otherwise observed in this piston type.

Metals having a low melting point, which are suitable for use as coolants, are, in particular, sodium or potassium. In particular, Galinstan® alloys, bismuth alloys having a low melting point, and sodium-potassium alloys can be used as metal alloys having a low melting point.

Alloy systems composed of gallium, indium, and tin, which are liquid at room temperature, are called Galinstan® alloys. These alloys consist of 65 wt.-% to 95 wt.-% gallium, 5 wt.-% to 26 wt.-% indium, and 0 wt.-% to 16 wt.-% tin. Preferred alloys are those, for example, having 68 wt.-% to 69 wt.-% gallium, 21 wt.-% to 22 wt.-% indium, and 9.5 wt.-% to 10.5 wt.-% tin (melting point −19° C.), 62 wt.-% gallium, 22 wt.-% indium, and 16 wt.-% tin (melting point 10.7° C.), as well as 59.6 wt.-% gallium, 26 wt.-% indium, and 14.4 wt.-% tin (ternary eutectic, melting point 11° C.).

Bismuth alloys having a low melting point are known in great numbers. These include, for example, LBE (eutectic bismuth-lead alloy, melting point 124° C.), Rose's metal (50 wt.-% bismuth, 28 wt.-% lead, and 22 wt.-% tin, melting point 98° C.), Orion metal (42 wt.-% bismuth, 42 wt.-% lead, and 16 wt.-% tin, melting point 108° C.); quick solder (52 wt.-% bismuth, 32 wt.-% lead, and 16 wt.-% tin, melting point 96° C.), d'Arcet's metal (50 wt.-% bismuth, 25 wt.-% lead, and 25 wt.-% tin), Wood's metal (50 wt.-% bismuth, 25 wt.-% lead, 12.5 wt.-% tin, and 12.5 wt.-% cadmium, melting point 71° C.), Lipowitz' metal (50 wt.-% bismuth, 27 wt.-% lead, 13 wt.-% tin, and 10 wt.-% cadmium, melting point 70° C.), Harper's metal (44 wt.-% bismuth, 25 wt.-% lead, 25 wt.-% tin, and 6 wt.-% cadmium, melting point 75° C.), Cerrolow 117 (44.7 wt.-% bismuth, 22.6 wt.-% lead, 19.1 wt.-% indium, 8.3 wt.-% tin, and 5.3 wt.-% cadmium, melting point 47° C.), Cerrolow 174 (57 wt.-% bismuth, 26 wt.-% indium, 17 wt.-% tin, melting point 78.9° C.), Field's metal (32 wt.-% bismuth, 51 wt.-% indium, 17 wt.-% tin, melting point 62° C.), and Walker's alloy (45 wt.-% bismuth, 28 wt.-% lead, 22 wt.-% tin, and 5 wt.-% antimony).

Suitable sodium-potassium alloys can contain 40 wt.-% to 90 wt.-% potassium. The eutectic alloy NaK with 78 wt.-% potassium and 22 wt.-% sodium (melting point −12.6° C.) is particularly suitable.

The heat transfer medium can additionally contain lithium and/or lithium nitride. If nitrogen is used as a protective gas during filling, it can react with the lithium to form lithium nitride and can be removed from the cavity in this manner.

The heat transfer medium can furthermore contain sodium oxides and/or potassium oxides, if any dry air that might be present has reacted with the heat transfer medium during filling.

Preferably, four bores are provided, which are disposed between a working surface and a pin bore, in order to achieve a particularly uniform temperature distribution in the piston.

It is practical if the at least one bore is closed off by means of a closure element, in order to prevent the heat transfer medium from exiting. The closure element can be provided at the free end of the piston skirt. Preferably, the closure element is provided in the piston crown, in order to be able to conveniently fill the cavity and the at least one bore.

Figure 2:
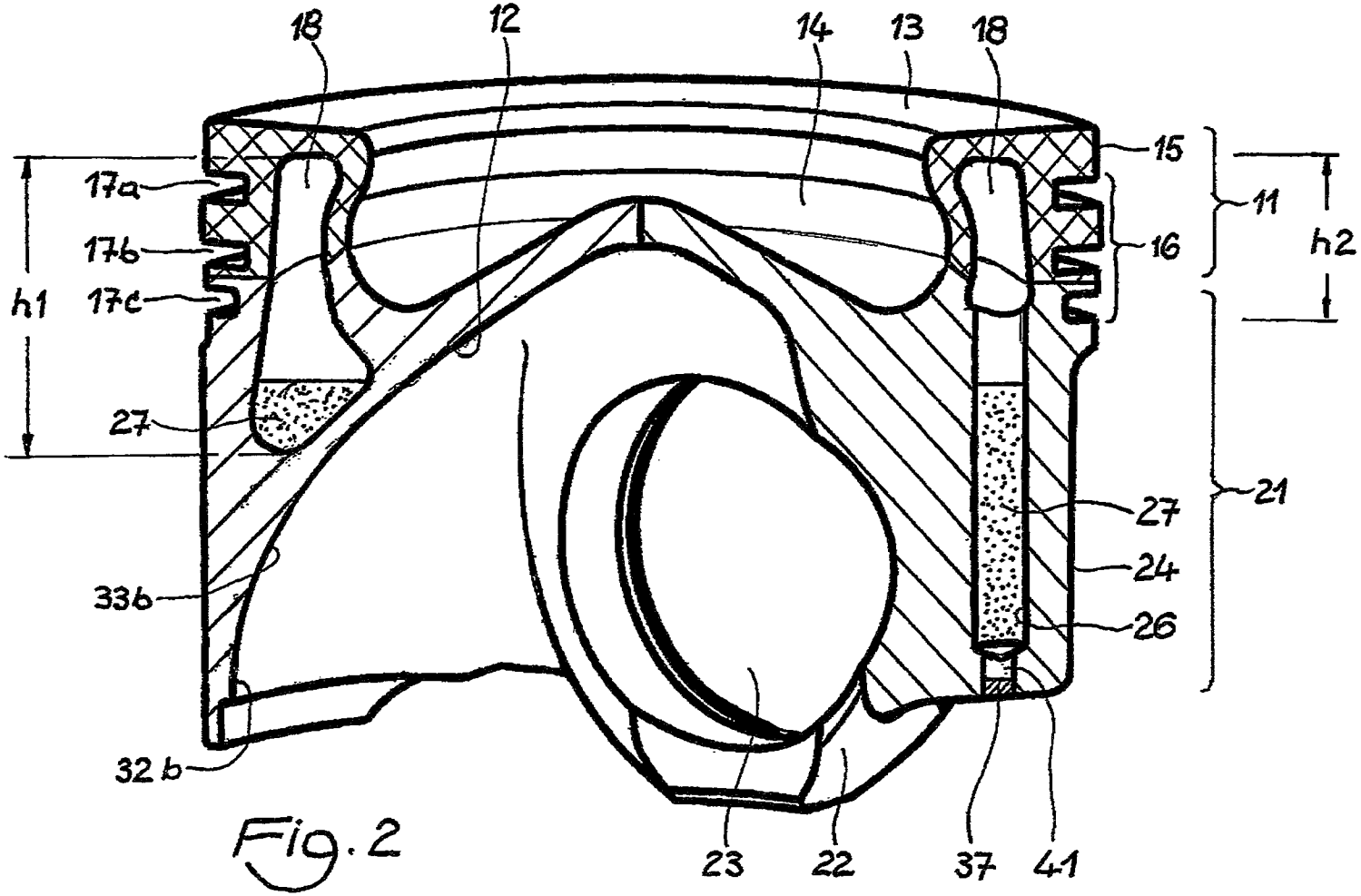
Figure 3:
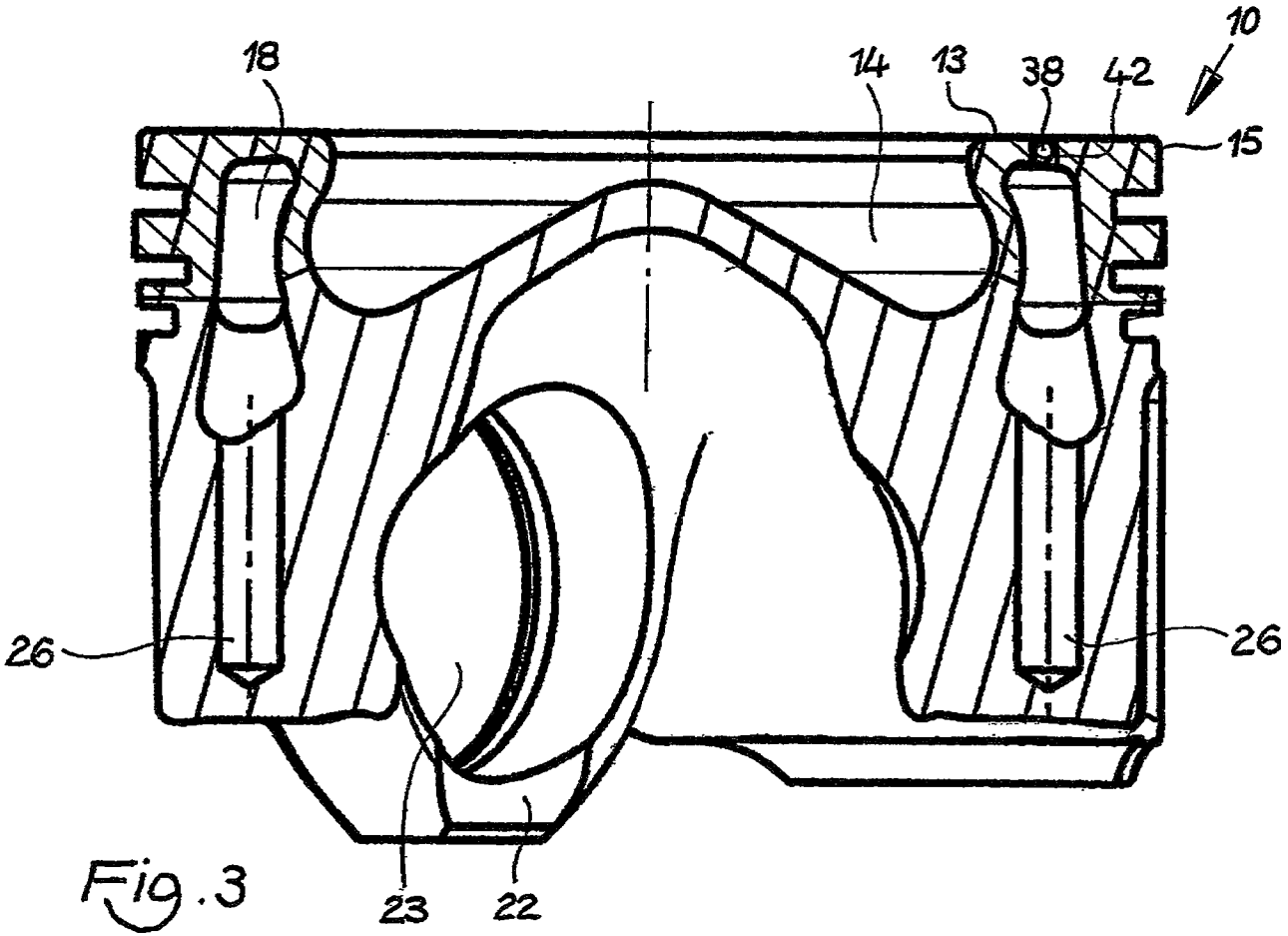

An exemplary embodiment of the present invention will be explained in greater detail below, using the attached drawings. These show, in a schematic representation, not true to scale:

FIG. 1 an exemplary embodiment of a piston according to the invention, in section;

FIG. 2 the piston according to FIG. 1 in a perspective representation, in section;

FIG. 3 the piston according to FIG. 1 in section through two bores that lie diagonally opposite one another.

FIGS. 1 to 3 show an exemplary embodiment of a piston 10 according to the invention. The piston 10 can be a one-part cast piston or a multi-part joined piston. The piston 10 can be produced from an iron-based material and/or from a light metal material. The piston 10 according to the exemplary embodiment shown in FIGS. 1 to 3 is filled with a metallic heat transfer medium, as described above. Heat transfer media that are solid and can be kneaded at room temperature, for example sodium, are preferred.

FIGS. 1 to 3 show a two-part joined box piston 10 as an example. The piston 10 has a piston head 11 having a piston crown 13 having a combustion bowl 14, a circumferential top land 15, and a circumferential ring belt 16 having ring grooves 17*a*, 17*b*, 17*c* for accommodation of piston rings (not shown). At the level of the ring belt 16, a circumferential, closed cavity 18 is provided, which does not have any inlet or outlet openings.

The piston 10 furthermore has a piston skirt 21 having pin bosses 22 and pin bores 23 for accommodation of a piston pin (not shown). The pin bosses 22 are connected with the piston head 11 in known manner, by way of pin boss connections. The pin bosses 22 are connected with one another by way of working surfaces 24, 25.

In the present exemplary embodiment, the piston 10 is composed of a piston base body 10*a* and a piston ring element 10*b*, which are produced in known manner by means of forging or casting, pre-machined, and joined by means of a welding method, particularly a laser welding method, thereby resulting in circumferential weld seams 10*c*, 10*d*. The piston 10 can, of course, also be joined together in known manner, from an upper piston part that comprises the piston head 11 and a lower piston part that comprises the piston skirt 21, for example. The piston 10 can also be configured as a one-part piston that is cast in known manner, whereby salt cores, for example, are used to form the cavity 18 and the bores 25 (see below).

In the exemplary embodiment, the piston 10 has four bores 26 (see, in particular, FIGS. 2 and 3). The bores 26 run approximately axially and parallel to the center piston axis M in the exemplary embodiment. The bores 26 can, however, also run inclined at an angle relative to the center piston axis M (not shown). The bores 26 are disposed between a working surface 24, 25 and a pin bore 23. The bores 26 open into the cavity 18. The coolant space 18 and the bores 26 are filled with a metallic heat transfer medium 27, sodium in the exemplary embodiment.

The size of the bores 26 and the fill amount of the heat transfer medium 27 are based on the size and the material of the piston 10. The cooling output can be controlled by way of the amount of the heat transfer medium 27 added, taking its heat conductivity coefficient into consideration. The fill amount should preferably amount to 5% to 10% of the total volume of the cavity 18 and of the bores 26. In this case, the known Shaker effect can be additionally utilized for particularly effective heat distribution in the piston 10 during operation. For sodium as a heat transfer medium 27, with a temperature during operation of maximally 350° C., a maximal surface temperature of the piston 10 of about 260° C. occurs at a cooling output of 350 $kW/m^2$.

During engine operation, the inside 12 of the piston 10 according to the invention is cooled by means of spray cooling. For this purpose, a spray-on nozzle 30 for a coolant is provided in the engine, in known manner (see FIG. 1), which nozzle is provided fixed in place on the crankcase, for example.

Of course, the piston according to the invention can also have a conventional cooling channel for cooling oil, which has inlet and outlet openings for the cooling oil. In the case of such a piston, as well, improved spray cooling in the region of the inside 12 is achieved by means of the configuration of the inside 12 of the piston 10 according to the invention.

To improve the cooling effect of the spray cooling, in this exemplary embodiment it is provided that the maximal height h1 of the cavity 18 in the region of the working surfaces 24, 25 is greater than the maximal height h2 in the region of the pin bosses 22 (see FIG. 2). This brings about the result that the heat transfer medium 27 conducts the heat transported by way of the cavity 18 from the direction of the piston crown 13, in the region of the working surfaces, away particularly effectively in the direction of the inside 12 of the piston 10. In the region of the working surfaces 24, 25, the wall thickness of the wall region 31 between the cavity 18 and the inside of the piston is so slight that effective heat transfer to the inside 12 of the piston 10 takes place, without impairing the stability of the piston 10. The symmetrically varying cross-section of the cavity 18 furthermore leads to the result that the piston 10 according to the invention is better balanced and therefore can be better guided in the cylinder during engine operation. Lower friction losses are found than those in the state of the art.

Furthermore, in the present exemplary embodiment it is provided that the lowermost ring groove 17*c* has a groove height h3, and that the groove height h3 is less than or equal to the distance a between the lower flank of the lowermost ring groove 17*c* and the lowest point of the cavity 18. The greater the difference between the groove height and the distance, the greater the maximal height of the cavity, and therefore the more effective the heat transfer from the heat transfer medium accommodated in the cavity to the inside of the piston. Furthermore, the greater the distance between the lower flank of the ring groove and the lowest point of the cavity, the less heat is transferred to the region of the lowermost ring groove during engine operation, so that the risk of carbonization is greatly reduced or completely prevented in this region.

Furthermore, it is provided, according to the invention, that proceeding from the free end of the piston skirt 21, in the piston interior, a first inner surface 32*a* of a working surface 24 makes a constant transition into a first guide surface 33*a* for coolant on the major thrust side DS and/or minor thrust side GDS, which guide surface in turn makes a constant transition into a first lower surface 34*a*. The first lower surface 34*a* in turn makes a constant transition into an arched surface 35, which is disposed in the region of the center piston axis M.

In the exemplary embodiment shown, it is furthermore provided that the arched surface 35 in turn makes a constant transition into a second arched lower surface 34*b*, which in turn makes a transition into a second guide surface 33*b* for coolant, which opens into a second inner surface 32*b* of a working surface 25, in constant manner.

The two inner surfaces 32*a*, 32*b* of the two guide surfaces 33*a*, 33*b*, the two lower surfaces 34*a*, 34*b*, and the arched surface 35 form the inside 12 of the piston 10.

This embodiment according to the invention brings about the result that the sprayed-on coolant is not directly thrown back from the impact location. Instead, the coolant jet impacts the guide surface 33*a* essentially tangentially, and is guided in such a manner that the coolant flows over the lower surface 34*a* in the direction of the arched surface 35. In an optimal case, the coolant flows back in the direction of the crankshaft from the arched surface 35, by way of the lower surface 34*b*, the guide surface 33*b*, and the inner surface 32*b*.

The coolant therefore flows back in the direction of the crankshaft with a significant delay. In the end result, for one thing, a significantly greater surface area on the inside 12 of the piston 10 is wetted with coolant and cooled, and for another thing, the coolant has a significantly longer dwell time on the inside 12 of the piston 10. This leads, in total, to a clearly stronger and more uniform cooling effect on the inside of the piston. The heat transported in the direction of the inside 12 of the piston 10 from the direction of the piston crown 13, by way of the cavity 18 and the combustion bowl 14, is conducted away significantly more effectively.

The exemplary embodiment shown is furthermore characterized in that the tangent T applied in the region of the inside 12, at an angle $\delta$ to the center piston axis M, encloses an angle $\beta$ with the center piston axis M. Furthermore, each lower surface 34*a*, 34*b* encloses an angle $\alpha$ with the center piston axis M. In this connection, the angle $\beta$ is less than or equal to the angle $\alpha$. The resulting geometry of the guide surfaces 33*a*, 33*b* and of the lower surfaces 34*a*, 34*b* allows particularly effective guiding of the sprayed-on coolant from the guide surface 33*a* to the lower surface 34*a*, as well as a particularly advantageous coolant flow, in terms of flow technology.

In the present exemplary embodiment, it is furthermore provided that an outer wall 36 of the cavity 18 facing the ring belt 16, in the direction of the piston crown 13, is configured to be inclined, at least in part, toward the center piston axis M. In the present case, the inclined outer wall 36 of the cavity 18 encloses an angle $\gamma$ of preferably 1° to 10° with an axis A parallel to the center piston axis M. This configuration brings about the result that the ring belt 16 is not excessively heated, and the risk of carbonization at the ring grooves is prevented. This effect is essentially based on the following mechanisms. As the result of the Shaker effect during engine operation, heated heat transfer medium 27 from the direction of the piston crown 13 is essentially moved vertically downward during the upward stroke of the piston 10. This has the result that contact between the outer wall 36 of the cavity 18 and the hot heat transfer medium 27 is prevented, to the greatest possible extent. The heat transfer medium 27 therefore gives off a significant part of its heat when it first impacts the spray-cooled outer wall of the cavity 18 in the direction of the inside 12 of the piston 10. The heat transfer medium 27, which is now less hot, can flow along the outer wall 36 of the cavity 18 in the direction of the piston crown 13, without excessively heating the ring belt 16. Furthermore, the outer wall 36 of the cavity 18 is configured to be thickened in the region of the ring belt 16, so that the passage of heat in the direction of the ring belt 16 is additionally reduced.

For production of the piston 10, a piston base body 10*a* and a piston ring element 10*b* are produced by means of forging or casting and pre-machined. Then, the metallic heat transfer medium 27, which is solid and can be kneaded at room temperature, is placed into the region of the piston base body 10*a*, which forms part of the cavity 18 in the finished piston 10 (see FIG. 1). Then the piston base body 10*a* and the piston ring element 10*b* are put together and joined by means of a welding method, for example laser welding, and firmly connected with one another, thereby resulting in circumferential weld seams 10*c*, 10*d*.

If a one-part piston is supposed to be produced or if a metallic heat transfer medium that is liquid at room temperature is used, a filling opening 37, 38 must be present. This filling opening can be provided either at the free end of the piston skirt 21 (filling opening 37 in FIG. 2) or in the piston crown 13 (filling opening 38 in FIG. 1). The filling opening is tightly sealed after filling with the heat transfer medium has taken place, by means of a closure element (closure element 41 in FIG. 2 or closure element 42 in FIG. 3). The closure element 41, 42 can be configured, for example, as a pressed-in steel ball, a welded-on lid, or a pressed-in cap.

To fill the piston 10 with a liquid heat transfer medium, a lance is introduced through the filling opening 37, 38, and flushed by means of nitrogen or by means of another suitable inert gas or by means of dry air. To introduce the heat transfer medium 27, this medium is guided through the filling opening 37, 38 under protective gas (for example nitrogen, inert gas or dry air), so that the heat transfer medium 27 is accommodated in the bores 26 and/or in the cavity 18.

A further method for filling the piston 10 is characterized in that after flushing with nitrogen, inert gas or dry air, the bores 26 and the cavity 18 are evacuated, and the heat transfer medium 27 is introduced in a vacuum. As a result, the heat transfer medium 27 can move back and forth in the cavity 18 and in and out in the bores 26 more easily, because it is not hindered by protective gas that is present.

Another possibility for removing the protective gas from the cavity 18 and the bores 26 consists in using nitrogen or dry air (i.e. essentially a mixture of nitrogen and oxygen) as the protective gas and adding a small amount of lithium to the heat transfer medium 27, empirically about 1.8 mg to 2.0 mg lithium per cubic centimeter of gas space (i.e. volume of the cavity 18 plus volume of the bores 26). While sodium and potassium, for example, react with oxygen to form oxides, the lithium reacts with nitrogen to form lithium nitride. The protective gas is thereby practically bound completely in the heat transfer medium 27, as a solid.

The invention claimed is:

1. Piston for an internal combustion engine, having a piston head and a piston skirt, wherein the piston head has a piston crown, a circumferential ring belt, as well as a circumferential, closed cooling channel or closed cavity in the region of the ring belt, wherein an inside of the piston has two lower surfaces that make a constant transition into an arched surface in the region of a center piston axis, wherein the piston skirt has pin bosses provided with pin bores, which pin bosses are connected with one another by way of working surfaces, which have inner surfaces that face the piston interior, wherein proceeding from the free end of the piston skirt, in the piston interior, an inner surface of a working surface makes a constant transition into a guide surface for coolant, on a major thrust side, on a minor thrust side, or on both a major thrust side and a on a minor thrust side, which guide surface in turn makes a constant transition into a lower surface, and wherein four bores closed toward the outside are provided, said bores being disposed between a working surface and a pin bore and opening into the cavity, wherein the cavity and the four bores contain a heat transfer medium in the form of a metal having a low melting point or a metal alloy having a low melting point.

2. Piston according to claim 1, wherein proceeding from the free end of the piston skirt, in the piston interior, the inner surface of the working surface makes the constant transition into the guide surface for coolant, on the major thrust side and on the minor thrust side.

3. Piston according to claim 1, wherein a tangent applied in the region of the inside, at a first angle to the center piston axis, encloses a second angle with the center piston axis, wherein each lower surface-encloses a third angle with the center piston axis, and wherein the second angle is less than or equal to the third angle.

4. Piston according to claim 3, wherein the tangent is applied in the region of a guide surface.

5. Piston according to claim 1, wherein a lowermost ring groove having a groove height is provided within the ring belt, wherein a distance is provided between the lower flank of the lowermost ring groove—and the lowest point of the cavity, and wherein the distance is equal to the groove height or greater than the groove height.

6. Piston according to claim 1, wherein an outer wall of the cavity facing the ring belt, in the direction of the piston crown, is configured to be inclined, at least in part, toward the center piston axis.

7. Piston according to claim 6, wherein the inclined outer wall of the cavity encloses an angle of 1° to 10° with an axis parallel to the center piston axis.

8. Piston according to claim 1, wherein the fill amount of the heat transfer medium amounts to 5% to 10% of the total volume of the cavity and of the at least one bore.

9. Piston according to claim 1, wherein the metal having a low melting point is sodium or potassium.

10. Piston according to claim 1, wherein the metal alloy having a low melting point is selected from the group comprising Galinstan alloys, bismuth alloys having a low melting point, and sodium-potassium alloys.

11. Piston according to claim 1, wherein at least one of the four bores is closed off via a closure element.

12. Piston according to claim 11, wherein the closure element is disposed at the free end of the piston skirt.

13. Piston according to claim 11, wherein the closure element is disposed in the piston crown.

* * * * *